United States Patent [19]

Niekawa et al.

[11] Patent Number: 4,563,663

[45] Date of Patent: Jan. 7, 1986

[54] CORE MEMBER FOR AN ELECTROMAGNETIC RELAY

[75] Inventors: Yukihisa Niekawa; Shigeyuki Tsuchiya, both of Yokohama, Japan

[73] Assignee: Fujisoku Electric Co. Ltd., Japan

[21] Appl. No.: 496,024

[22] Filed: May 19, 1983

[30] Foreign Application Priority Data

Jul. 16, 1982 [JP] Japan ..... 57-124137
Jul. 16, 1982 [JP] Japan ..... 57-107730[U]
Feb. 28, 1983 [JP] Japan ..... 58-28308[U]

[51] Int. Cl.[4] ..... H01H 51/22

[52] U.S. Cl. ..... 335/78; 335/79; 335/80

[58] Field of Search ..... 335/78, 79, 80, 81, 335/84

[56] References Cited

U.S. PATENT DOCUMENTS 3,022,400 2/1962 Ahlefeldt ..... 335/81
4,142,166 2/1979 Arnoux ..... 335/81
4,334,748 6/1982 Stacklies et al. ..... 335/79 X

FOREIGN PATENT DOCUMENTS 5675446 6/1979 Japan .
5730232 2/1980 Japan ..... 335/81
5731757 2/1980 Japan .

OTHER PUBLICATIONS

A book (in Japanese) entitled "How to Select and Use Relays", issued by Ohm Co., Ltd. on Aug. 31, 1976, p. 19, Fig. 1.32.

*Primary Examiner*—George Harris
*Attorney, Agent, or Firm*—Nilsson, Robbins, Dalgarn, Berliner, Carson & Wurst

[57] ABSTRACT

One end of a yoke is arranged near one end of an iron core of an electromagnet. The other end of the yoke is coupled to the other end of the iron core. The one end of the yoke has side walls which oppose the side surfaces of the one end of the iron core, and a bottom which opposes the bottom of the iron core. The magnetic pole at the other end of the iron core is guided to the other end of the yoke. A movable member is disposed at the one end of the iron core. The movable member comprises a permanent magnet disposed at the center of a frame, and iron pieces, one end of each of which abuts against the poles of the permanent magnet. The movable member partially surrounds the iron core so that the iron pieces are located between the iron core and the side walls of the yoke. The movable member is moved in the direction perpendicular to the axis of the iron core by the sum of the magnetic fields of the permanent magnet and the electromagnet. A contact mechanism is arranged near the electromagnet and is driven by projections formed on the movable member.

9 Claims, 15 Drawing Figures

FIG. 4
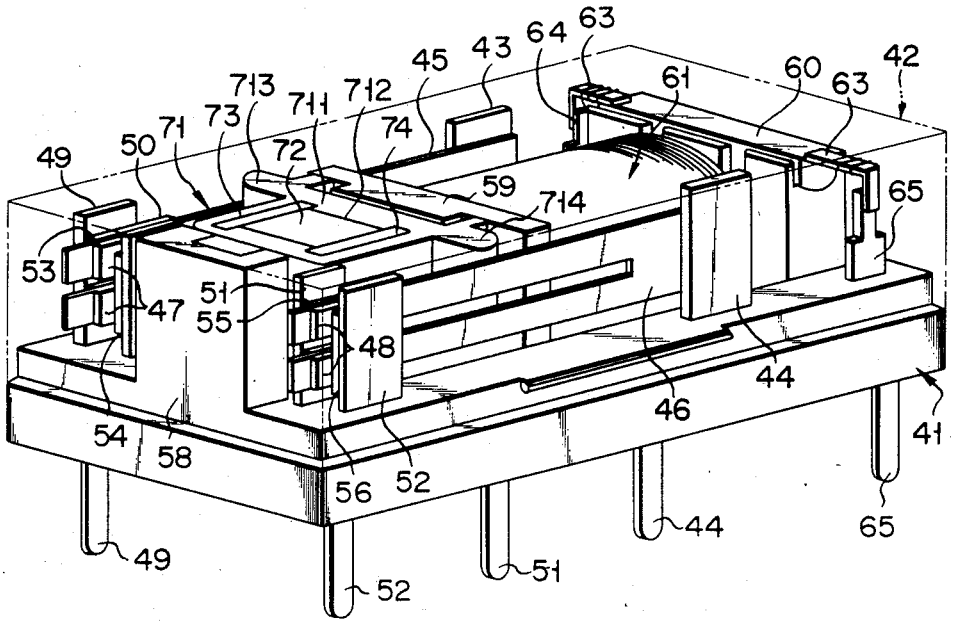
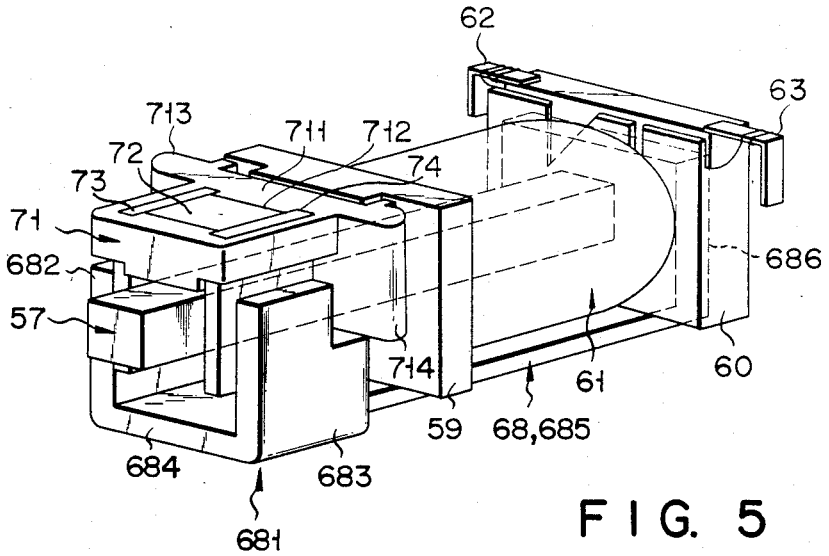
FIG. 5

CORE MEMBER FOR AN ELECTROMAGNETIC RELAY

BACKGROUND OF THE INVENTION

The present invention relates to an electromagnetic relay using a permanent magnet.

Various types of electromagnetic relays using permanent electromagnets are known. FIGS. 1 and 2 show one such conventional electromagnetic relay. Referring to these figures, holding portions 12 and 13 are formed at a predetermined distance on a substrate 11. Proximal ends 141 and 151 of movable contact pieces 14 and 15 extend through the holding portion 12 to be held thereby. Similarly, proximal ends 161 and 171 of movable contact pieces 16 and 17 extend through the holding portion 13 to be held thereby. Movable contacts 142 and 152 are formed on the pair of movable contact pieces 14 and 15 to oppose each other. Similarly, movable contacts 162 and 172 are formed on the pair of movable contact pieces 16 and 17 to oppose each other. Stationary contacts 18 and 19 are arranged at predetermined distances between the corresponding pairs of contacts 142 and 152 and of contacts 162 and 172, respectively. The stationary contacts 18 and 19 are arranged on terminals 181 and 191, respectively, proximal ends whereof extend through a holding portion 20 formed on the substrate 11.

A pivotal plate 21 is mounted on the substrate 11. The pivotal plate 21 comprises an arm 211 and a leg 212, forming an overall T shape. A through hole 213 is formed at the center of the pivotal plate 21 and receives a pin 22 extending upright from the substrate 11. Therefore, the pivotal plate 21 is pivotal about the pin 22 in the direction indicated by arrows A and B. A movable member 23 is mounted at the distal end of the leg 212. The movable member 23 comprises a permanent magnet 24 and iron pieces 25 and 26 whose proximal ends abut against the poles of the permanent magnet 24. Projections 214 and 215 are formed on two ends, respectively, of the arm 211. The projections 214 and 215 are respectively located between the movable contact pieces 14 and 15 and the movable contact pieces 16 and 17. As the pivotal plate 21 pivots, the projections 214 and 215 drive the movable contact pieces 14 and 15 and the movable contact pieces 16 and 17, respectively.

A substantially E-shaped iron core 27 constituting an electromagnet is arranged above the pivotal plate 21. The iron core 27 comprises a central portion 271 and first and second side portions 272 and 273. A coil 28 is mounted on the central portion 271. The iron core 27 having such a structure is fitted in and held by steps 121, 131 and 201 formed in the holding portions 12, 13 and 20. In the held state of the iron core 27, the distal ends of the iron pieces 25 and 26 of the movable member 23 are respectively located between the central portion 271 and the first and second side portions 272 and 273 of the iron core 27.

In the electromagnetic relay of the structure as described above, when the coil 28 is energized to magnetize the central portion 271 of the iron core 27 to the S pole, for example, and the first and second side portions 272 and 273 to the N pole, the iron pieces 25 and 26 magnetized to the S and N poles, respectively, by the permanent magnet 24 are attracted toward the first side portion 272 and the central portion 271, respectively. As a result, the pivotal plate 21 pivots about the pin 22 in the direction of arrow A, and this state is maintained even after the coil 28 is deenergized. When the coil 28 is energized in the direction opposite to that described above, the pivotal plate 21 is pivoted in the direction indicated by arrow B. The pivotal plate 21 operates in this manner so as to change the contact states of the contacts 142 to 172 of the movable contact pieces 14 to 17 and the stationary contacts 18 and 19.

The electromagnetic relay having the above structure can provide a necessary function as an electromagnetic relay. However, in this conventional electromagnetic relay, the movable member 23 is subject to a magnetic field acting in the direction perpendicular to the axis of the central portion 271 of the iron core 27, and tends to move linearly along this direction. However, in practice, the pivotal plate 21 pivots about the pin 22. For this reason, friction is generated between the pivotal plate 21 and the pin 22, so that the magnetic field acting on the movable member 23 may not be efficiently transmitted to the pivotal plate 21.

The friction generated between the pivotal plate 21 and the pin 22 and between the movable contact pieces 14 to 17 and the projections 214 and 215 changes in accordance with the posture of the relay mounted on a printed circuit board or the like. Accordingly, it is difficult to improve the sensitivity (power consumed by the coil for driving the same contact mechanism; smaller power means better sensitivity) of the relay. Moreover, the sensitivity of the relay varies in accordance with the posture of the relay.

The central portion 271 and the first and second side portions 272 and 273 of the iron core 27 are elongated, resulting in long magnetic paths and hence, relatively great magnetic reluctance. Then, the magnetic flux generated by the permanent magnet 24 may not be easily shielded and may permeate through the first and second side portions 272 and 273. The magnetic flux then leaks to the outside through a casing (not shown) and the substrate 11. In particular, leakage flux is easily caused in the direction perpendicular to the plane of the substrate 11. Therefore, nearby arrangement of another electromagnetic relay or the like in this direction may adversely affect the operation characteristics thereof.

Since the iron core 27 has the central portion 271 and the first and second side portions 272 and 273 arranged in the transverse direction, the overall width is considerably great. Accordingly, it is difficult to produce a compact electromagnetic relay.

SUMMARY OF THE INVENTION

It is an object of the present invention to provide an electromagnetic relay of excellent sensitivity, which efficiently utilizes a magnetic field produced by an electromagnet and a permanent magnet.

It is another object of the present invention to provide an electromagnetic relay which does not substantially cause variations in sensitivity even if its mounting posture is changed.

It is still another object of the present invention to provide an electromagnetic relay which causes little leakage flux to the outside of a casing and which does not adversely affect other electronic equipment mounted nearby.

It is still another object of the present invention to provide an extremely compact electromagnetic relay.

It is still another object of the present invention to provide a self-hold electromagnetic relay having the features as described above.

It is still another object of the present invention to provide a monostable electromagnetic relay having the features as described above.

The present invention thus provides a novel electromagnetic relay. In the electromagnetic relay of the present invention, a movable member having a permanent magnet at the center and two iron pieces, one end of each of which corresponds to the two poles of the permanent magnet, partially surround one end of the iron core. The magnetic poles generated in the other end of the iron core are guided through a yoke to the outside of the movable member. Thus, the movable member is driven in the direction perpendicular to the iron core by the sum of the magnetic fields produced by the yoke, the iron core and the permanent magnet. A contact mechanism is arranged near the electromagnet, and is switched in accordance with the operation of the movable member.

BRIEF DESCRIPTION OF THE DRAWINGS

FIG. 4 is a perspective view of the relay shown in FIG. 3;

FIG. 5 is a perspective view of the main portion of the relay shown in FIGS. 3 and 4;

DETAILED DESCRIPTION OF THE PREFERRED EMBODIMENTS

Figure 1:
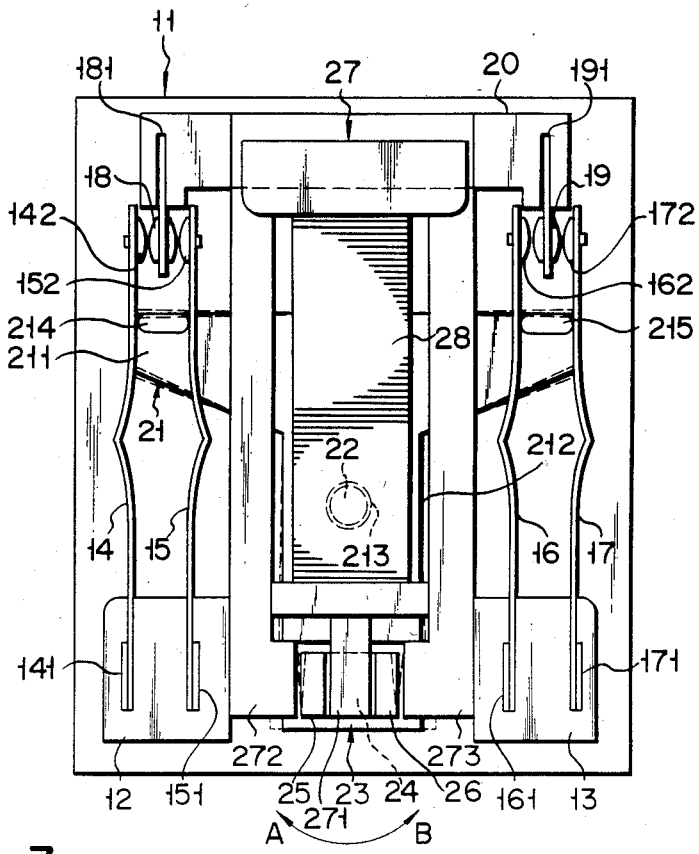
FIG. 1 (PRIOR ART)
FIG. 1 is a top view showing a conventional electromagnetic relay.
Figure 3:
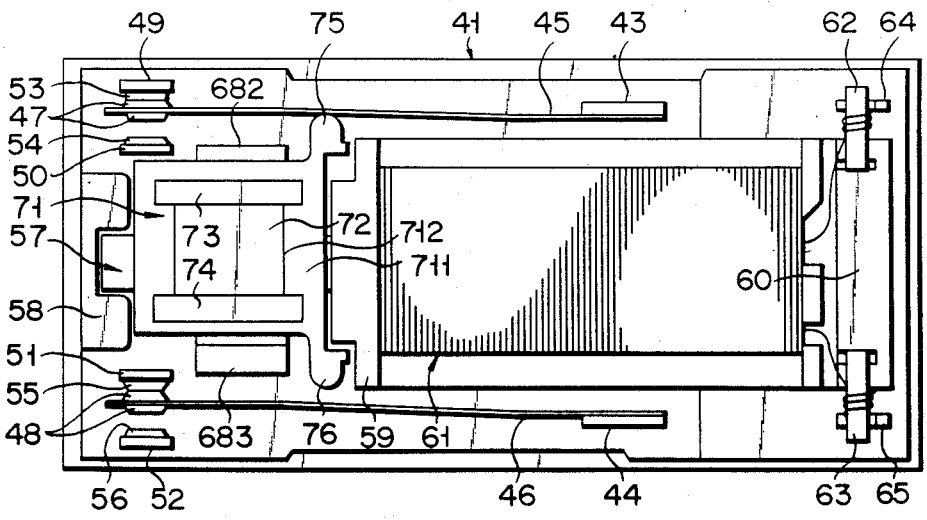
FIG. 3 is a top view showing an electromagnetic relay according to an embodiment of the present invention.
Figure 2:
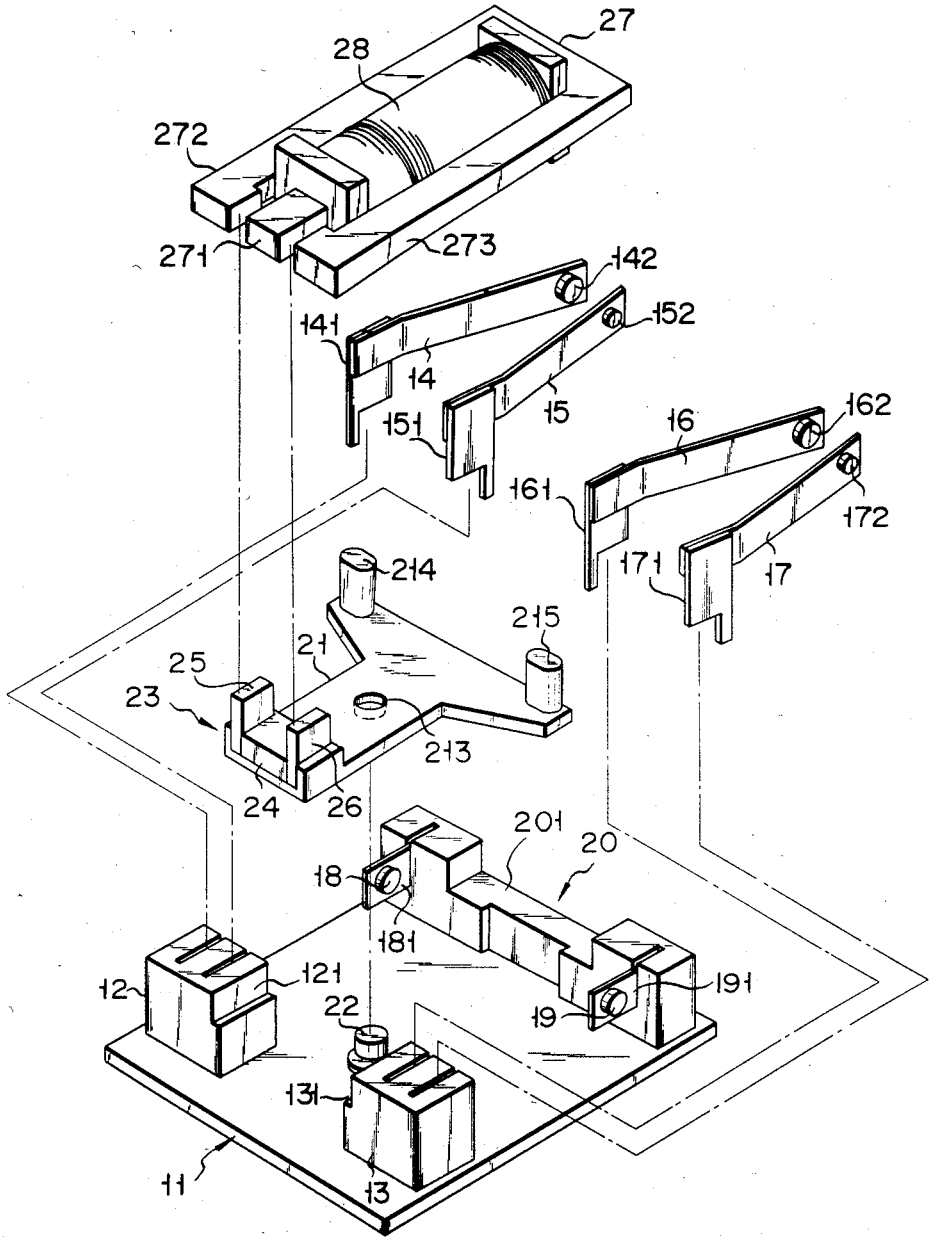
FIG. 2 (PRIOR ART)
FIG. 2 is an exploded perspective view of the relay shown in FIG. 1.

Referring to FIGS. 3 and 4, a casing 42 comprising a resinous material is mounted on a substrate 41. Terminals 43 and 44 are mounted at a predetermined distance on the substrate 41. One end of each of the movable contact pieces 45 and 46, which constitute a contact mechanism and which are arranged along the longitudinal direction of the substrate 41, is mounted on the terminals 43 and 44, respectively. Movable contacts 47 and 48 are formed at the other end of each of the movable contact pieces 45 and 46. The contacts 47 and 48 are respectively interposed between a pair of terminals 49 and 50 and another pair of terminals 51 and 52 which are formed on the substrate 41. A pair of stationary contacts 53 and 54 and another pair of stationary contacts 55 and 56 are arranged on the terminals 49, 50, 51 and 52, respectively, such that they may be brought into contact with the contacts 47 and 48. The other end of each of the movable contact pieces 45 and 46 having elasticity is biased inward so that they come close to each other.

An iron core 57 constituting an electromagnet is arranged at the center of the surface portion of the substrate 41 which is located between the movable contact pieces 45 and 46. One end of the iron core 57 is held by a holding portion 58 formed on the substrate 41. A coil 61 wound around a bobbin (not shown) comprising a resinous material and having flanges 59 and 60 is mounted on the other end of the iron core 57. The two ends of the coil 60 are connected to terminals 62 and 63 mounted on the flange 60. The terminals 62 and 63 are connected to terminals 64 and 65 mounted on the substrate 41.

One end 681 of a yoke 68 is located near one end of the iron core 57, as shown in FIG. 5. The one end 681 of the yoke 68 has side walls 682 and 683 extending at the two sides of a bottom 684. The side walls 682 and 683 and the bottom 684 surround the iron core 57 at a distance therefrom. A central portion 685 of the yoke 68 extends along the lower surface of the coil 61, and the other end 686 of the yoke 68 is coupled to the other end of the iron core 57 inside the flange 60.

A movable member 71 is mounted at the one end portion of the iron core 57. The movable member 71 comprises a frame 711 of a resinous material or the like, a permanent magnet 72, and iron pieces 73 and 74. A through hole 712 is formed at the central portion of the frame 711 and receives the permanent magnet 72. One end of each of the iron pieces 73 and 74 abuts against the poles of the permanent magnet 72. In this state, the permanent magnet 72 and the iron pieces 73 and 74 are securely held by the frame 711. The permanent magnet 72 consists of a rare-earth element such as samarium (Sm), nickel (Ni), cobalt (Co), and the like. The movable member 71 of the above-mentioned configuration is arranged to partially surround the one end of the iron core 57 such that the iron pieces 73 and 74 are respectively located between the iron core 57 and the side walls 682 and 683 of the yoke 68. In this state, as shown in FIG. 3, the movable member 71 is guided by the holding portion 58 and the flange 59 so as to be movable along the direction perpendicular to the axis of the iron core 57. Drive members such as projections 713 and 714 are formed integrally with the two ends of the movable member 71 in the moving direction thereof. The projections 713 and 714 serve to drive the movable contact pieces 45 and 46.

FIG. 6 shows a circuit diagram of a drive circuit of the electromagnetic relay as described above, and the same references in FIG. 6 denote the same parts as in FIGS. 3 and 5.

Figure 6:
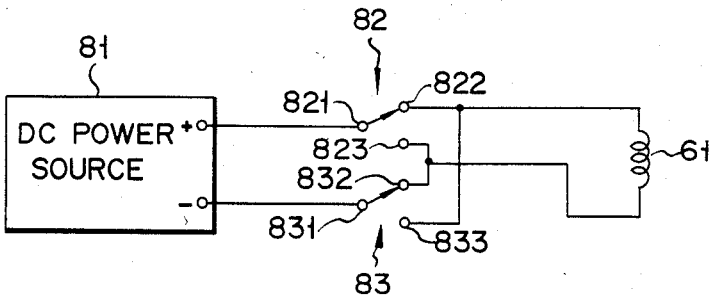
FIG. 6 is a circuit diagram for explaining the configuration of a coil shown in FIGS. 3 to 5.

Referring to FIG. 6, the positive and negative terminals of a DC power source 81 are respectively connected to movable contacts 821 and 831 of switches 82 and 83, respectively. A stationary contact 822 of the switch 82 is connected to one end of the coil 61 and to a stationary contact 833 of the switch 83. A stationary contact 832 of the switch 83 is connected to the other end of the coil 61 and to a stationary contact 823 of the switch 82. The energizing direction of the coil 61 may be changed by switching the movable contacts 821 and 831 of the switches 82 and 83 in synchronism with each other.

The mode of operation of the electromagnetic relay of the configuration as described above will now be described.

Figure 7:
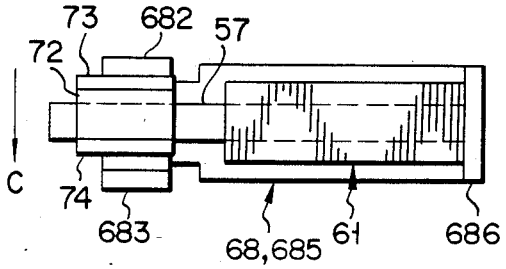
FIGS. 7 and 8 are schematic views for explaining the mode of operation of the relay shown in FIGS. 3 to 6.

The iron pieces 73 and 74 of the movable member 71 are constantly magnetized by the permanent magnet 72; the iron piece 73 is magnetized to the S pole, for example, and the iron piece 74 is magnetized to the N pole. Even if the coil 61 is not energized, the iron pieces 74 and 73 are attracted to the iron core 57 and to the side wall 682, respectively, as shown in FIG. 7. Thus, the movable contact piece 45 is urged by the projection 713 of the movable member 71, and the contact 47 is brought into contact with the contact 53 of the terminal 49. The movable contact piece 46 is biased by its own elasticity, and the contact 48 is in contact with the contact 55 of the terminal 51.

Figure 8:
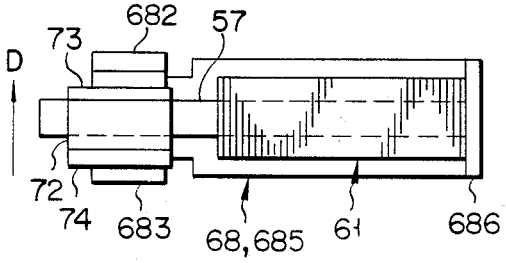

When the coil 61 is energized in this condition, the one end of the iron core 57 is magnetized to the N pole and the other end is magnetized to the S pole. The side walls 682 and 683 of the yoke 68 are also magnetized to the S pole. The iron piece 73 of the movable member 71 is repelled by the side wall 682 and is attracted by the iron core 57. The iron piece 74 is repelled by the iron core 57 and is attracted by the side wall 683. Therefore, the movable member 71 is linearly moved in the direction indicated by arrow C in FIG. 7 to a state shown in FIG. 8. The movable contact piece 46 is urged by the projection 714 of the movable member 71, and its contact 48 is switched from contact 55 to contact 56. The movable contact piece 45 is now biased by its own elasticity, and its contact 47 is switched from contact 53 to contact 54. Even after the coil 61 is deenergized in this condition, this contact state is maintained.

When the coil 61 is energized in the opposite direction in this condition, the one end of the iron core 57 is magnetized to the S pole and the other end thereof is magnetized to the N pole. The side walls 682 and 683 of the yoke 68 are also magnetized to the N pole. Then, the iron piece 73 of the movable piece 71 is repelled by the iron core 57 and is attracted by the side wall 682. The iron piece 74 is repelled by the side wall 683 and is attracted by the iron core 57. As a result, the movable member 71 is linearly moved in the direction indicated by arrow D in FIG. 8 to a state shown in FIG. 7. The contact condition is thus returned to the original condition.

In the electromagnetic relay of the above configuration, the movable member 71 is movable in the direction perpendicular to the axis of the iron core 57 by the sum of the magnetic fields of the permanent magnet 72 produced by the iron pieces 73 and 74 of the movable member 71 and of the magnetic field produced by the iron core 57 and the side walls 682 and 683. For this reason, the magnetic field acting in the direction perpendicular to the axis of the iron core 57 may be effectively transmitted to the movable member 71.

Thus, the movable member 71 is moved in the direction perpendicular to the axis of the iron core 57, and may not be brought into contact with the flange 59 of the bobbin and the holding portion 58 of the substrate 41. Substantially no friction is generated by the movable member 71. Since the magnetic field is efficiently transmitted to the movable member 71, improved sensitivity may be obtained.

Also, since the friction acting on the movable member 71 is extremely small, degradation in the sensitivity due to a change in the mounting posture of the relay may be reduced to the minimum.

The side walls 682 and 683 and the bottom 684 of the yoke 68 surrounding the movable member 71 form a closed magnetic circuit which is short and has a small magnetic reluctance. Since most of the magnetic flux generated by the permanent magnet 72 of the movable member 71 passes through this closed magnetic circuit, only a small amount of magnetic flux leaks outside the relay through the substrate 41 and the casing 42. The operation of electronic equipment which may be mounted close to this electromagnetic relay will not be adversely affected.

Figure 9A:
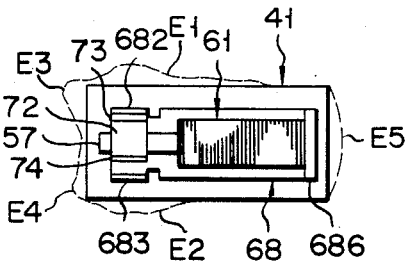
FIGS. 9A and 9B are representations for explaining the leakage flux caused in the relay of the present invention.
Figure 9B:
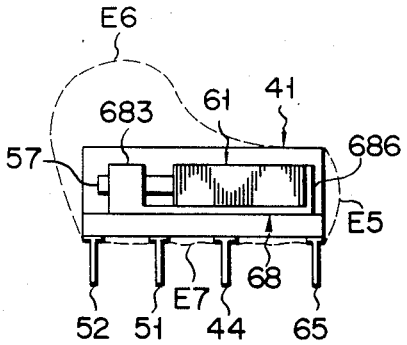

FIGS. 9A and 9B show representations for measurements of leakage flux on the surfaces of the substrate 41 and the casing 42 when the magnetic flux density of the permanent magnet 72 is 800 G. In each figure, each point of measurement is connected by the broken line. Measurements at the respective points were: E1=11 G, E2=10 G, E3=20 G, E4=10 G, E5=10 G, E6=115 G, and E7=4 G. In this manner, the leakage flux through the sides of the substrate 41 and the casing 42 of the electromagnetic relay may be reduced to the minimum according to the present invention.

In the electromagnetic relay of the present invention, the yoke 68 does not have first and second side portions 272 and 273, unlike a conventional electromagnetic relay, and the side walls 682 and 683 are disposed at the one end 681 of the yoke 68. Therefore, the width of the yoke 68 may not become greater than that of the electromagnet, so that the distance between the movable contact pieces 45 and 46 may be smaller than that of the conventional relay, thus providing a compact electromagnetic relay.

In the above description, the direction of the power to be supplied to the coil 61 is switched by the switches 82 and 83. However, the present invention is not limited to this configuration.

Figure 10:
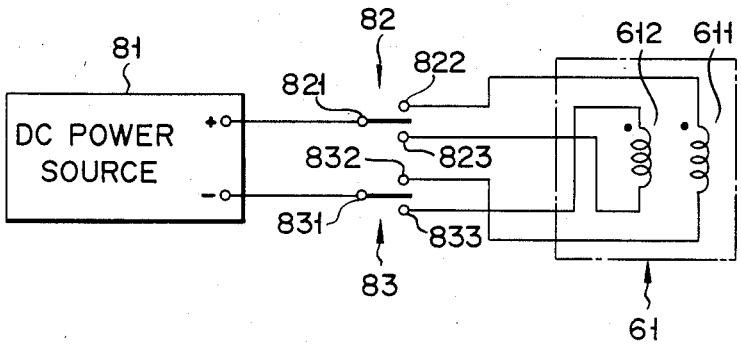
FIGS. 10 and 11 are circuit diagrams showing other examples of the coil shown in FIGS. 3 to 5.

FIG. 10 shows another example of the coil 61. The coil 61 shown in FIG. 10 has a primary coil 611 and a secondary coil 612 which are wound in the same direction. The positive and negative terminals of a DC power source 81 are connected to movable contacts 821 and 831 of switches 82 and 83, respectively. A stationary contact 822 of the switch 82 is connected to one end of the primary coil 611, the other end of which is connected to a stationary contact 832 of the switch 83. A stationary contact 833 of the switch 83 is connected to one end of the secondary coil 612, the other end of which is connected to a stationary contact 823 of the switch 82.

With the coil of this configuration, magnetic fields of opposite directions may be produced in the primary and secondary coils 611 and 612 by switching the switches 82 and 83 in synchronism with each other. Thus, the movable member 71 may be driven in a manner similar to that described above.

Figure 11:
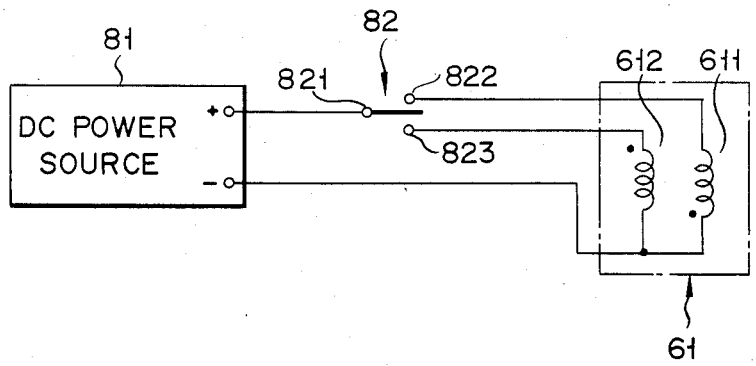

FIG. 11 shows another example of the coil 61. Referring to FIG. 11, the coil 61 comprises a primary coil 611 and a secondary coil 612 which are wound in opposite directions. The positive terminal of a DC power source 81 is connected to a movable contact 821 of a switch 82, stationary contacts 822 and 823 of which are connected to one end of each of the primary and secondary coils 611 and 612, respectively. The other end of each of the primary and secondary coils 611 and 612 is connected to the negative terminal of the DC power source 81.

With the coil of this configuration, magnetic fields of opposite directions may be produced in the primary and secondary coils 611 and 612 in accordance with the switching operation of the switch 82. Thus, the movable member 71 may be driven in a manner similar to that described above.

An electromagnetic relay according to another embodiment of the present invention will now be described with reference to FIGS. 12 to 14. The same reference numerals in FIGS. 12 to 14 denote the same parts in FIGS. 3 to 8, and a detailed description will be omitted.

Figure 12:
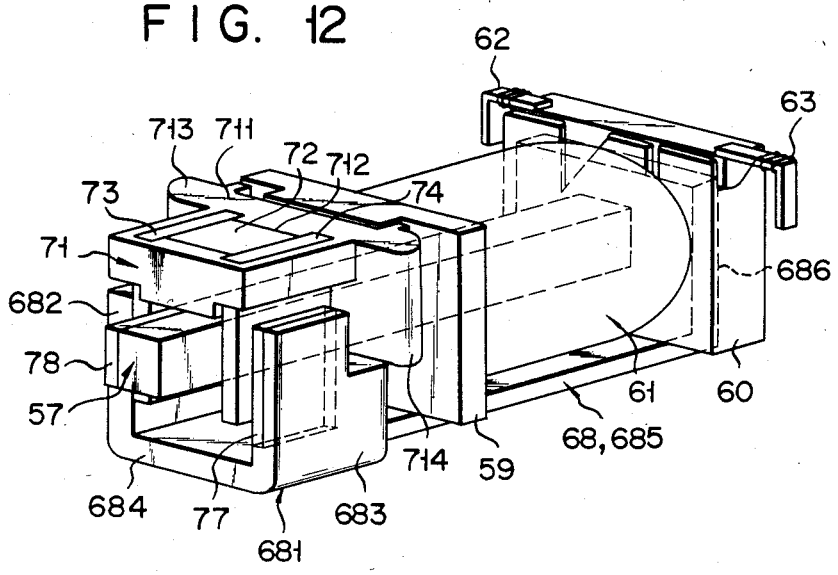
FIG. 12 is a perspective view showing a main part of an electromagnetic relay according to another embodiment of the present invention.
Figure 13:
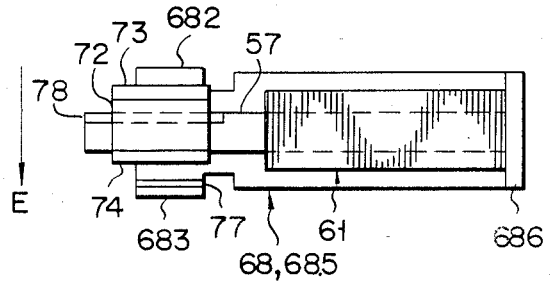
FIGS. 13 and 14 are schematic views showing the configuration of the relay shown in FIG. 12 for explaining the mode of operation thereof.

Referring to FIG. 12, magnetic shielding bodies 77 and 78 consisting of a nonmagnetic material are respectively arranged on the surface of a side wall 683 at one end 681 of a yoke 68 which opposes an iron core 57, and on the surface of the iron core 57 which opposes a side wall 682. In the relay of this configuration, iron pieces 73 and 74 of a movable member 71 are magnetized by a permanent magnet 72; the iron piece 73 is magnetized to the S pole, for example, and the iron piece 74 is magnetized to the N pole. The magnetic shielding body 77 is arranged on the surface of the side wall 683 which opposes the iron core 57, while the magnetic shielding body 78 is arranged on the surface of the iron core 57 which opposes the side wall 682, thereby shielding the magnetic paths. Therefore, when the coil 61 is not energized, the iron pieces 74 and 73 abut against the iron core 57 and the yoke 68, respectively, as shown in FIG. 13, due to the action of the magnetic field acting between the iron piece 74 and the iron core 57. In this state, a movable contact piece 45 is urged by a projection 713 of the movable member 71, and its contact 47 is brought into contact with a contact 53 of a terminal 49. A movable contact piece 46 is biased by its own elasticity, and its contact 48 is brought into contact with a contact 55 of a terminal 51.

In this state, when the coil 61 is energized and the one end of the iron core 57 is magnetized to the N pole, the iron pieces 74 and 73 are repelled by the iron core 57 and the side wall 682. Then, the movable member 71 is linearly moved in the direction indicated by arrow E in FIG. 13 to achieve a state shown in FIG. 13. Therefore, as in the case of the first embodiment described above, a contact 48 of the movable contact piece 46 is switched from the contact 55 to a contact 56, while a contact 47 of the movable contact piece 45 is switched from the contact 53 to a contact 54.

Figure 14:
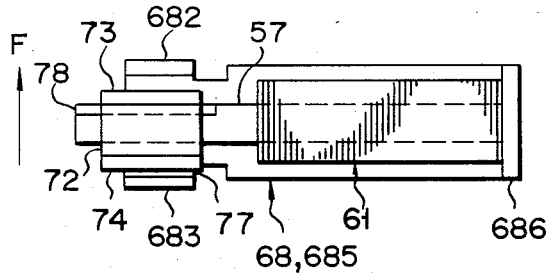

When the coil 61 is deenergized in this state, the movable member 71 moves in the direction indicated by arrow F in FIG. 14 due to the attraction force of the iron piece 74 and the iron core 57 and the elasticity of the movable contact piece 46, and because the magnetic shielding bodies 77 and 78 shield the magnetic paths between the iron piece 73 and the iron core 57 and between the iron piece 74 and the side wall 683. Consequently, the movable member 71 is returned to the state shown in FIG. 13, and the contact state of the respective contacts is returned to the state described above.

Similar effects to those obtained in the first embodiment may be obtained in this embodiment. Moreover, the second embodiment provides a monostable electromagnetic relay in which the movable member 71 and the movable contact pieces 45 and 46 return to the original positions when the coil 61 is deenergized.

What we claim is:

1. An electromagnetic relay for driving a movable member utilizing a sum of magnetic fields acting in different directions and produced by an electromagnet and a magnetic field produced by a permanent magnet, and for switching a contact mechanism in synchronism with an operation of said movable member, comprising:

an electromagnet having first and second ends and including an iron core, a coil wound around said iron core, said electromagnet being capable of changing its energizing direction;

a yoke of magnetic material having a central portion and first and second ends, said first and second ends of said yoke and said iron core being disposed adjacent each other, said first end of said yoke having a pair of side walls each of which is disposed at a predetermined distance from opposite sides of said first end of said iron core, and the second ends of said yoke and core being coupled together whereby the magnetic pole of the second end of said iron core is produced near two side surfaces at said first end of said iron core;

a movable member including a permanent magnet which has at the center thereof, an iron piece coupled to each pole of said permanent magnet, one of said iron pieces extending into the space between each sidewall and said iron core, and said movable member being movable in a direction perpendicular to an axis iron core when said coil is energized;

said contact mechanism arranged near said electromagnet; and a drive member, disposed on said movable member, for driving said contact mechanism in accordacne with movement of said movable member.

2. An electromagnetic relay according to claim 1, wherein said first end of said yoke has a bottom interconnecting said side walls, said side walls and said bottom providing a magnetic shield.

3. An electromagnetic relay according to claim 1, wherein magnetic shielding bodies are disposed on side surfaces of said iron core which respectively oppose inner surfaces of said side walls.

4. An electromagnetic relay according to claim 1, wherein said coil constituting said electromagnet comprises a primary coil and a secondary coil which are wound in the same direction, voltages of different polarities from a power source being supplied to said primary and secondary coils.

5. An electromagnetic relay according to claim 1, wherein said coil constituting said electromagnet comprises a primary coil and a secondary coil which are wound in opposite directions, voltages of the same polarity from a power source being supplied to said primary and secondary coils.

6. An electromagnetic relay according to claim 1, wherein said coil constituting said electromagnet comprises a primary coil alone, which receives voltages of different polarities from a power source.

7. In an electromagnetic relay having:

an electromagnet having a coil mounted on an iron core, one magnetic pole thereof being led from one end portion of said iron core to the vicinity of both side surfaces of the other end portion of the iron core;

a movable member having at its central part a permanent magnet, end portions of iron pieces being attached to both magnetic poles of said permanent magnet, said iron pieces being located between said other end portion of the iron core and said one magnetic pole, and said movable member being movable when the coil is energized;

a contact mechanism provided near the electromagnet; and a driving member provided on said movable member to drive the contact mechanism when the movable member is moved, the improvement comprising:

said electromagnet including a yoke of magnetic material having one end portion which is provided with opposed side walls spaced from said other end portion of the iron core, a central portion extending along the iron core and the other end portion provided at and coupled with said one end portion of the iron core.

8. The electromagnetic relay according to claim 1 characterized in that said permanent magnet is located above the upper surface of the iron core.

9. The electromagnetic relay according to claim 1 characterized in that non-magnetic bodies are disposed in the inner surface of one of said side walls and in a side surface of the iron core facing the inner surface of the other side wall.

* * * * *